US011214964B2

(12) United States Patent
Dombowsky et al.

(10) Patent No.: US 11,214,964 B2
(45) Date of Patent: Jan. 4, 2022

(54) REINFORCED STRUCTURAL INSULATION PANEL WITH CORNER BLOCKS

(71) Applicant: Nexii Building Solutions Inc., Vancouver (CA)

(72) Inventors: Michael Anthony Dombowsky, Vancouver (CA); Benedict John Dombowsky, Vancouver (CA)

(73) Assignee: Nexii Building Solutions Inc., Vancouver (CA)

( * ) Notice: Subject to any disclaimer, the term of this patent is extended or adjusted under 35 U.S.C. 154(b) by 0 days.

(21) Appl. No.: 16/442,292

(22) Filed: Jun. 14, 2019

(65) Prior Publication Data

US 2020/0392731 A1 Dec. 17, 2020

(51) Int. Cl.

| | |
|---|---|
| ***E04C 2/296*** | (2006.01) |
| ***E04B 1/74*** | (2006.01) |
| ***E04B 2/00*** | (2006.01) |
| ***E04C 2/42*** | (2006.01) |

(52) U.S. Cl.

CPC ..... *E04C 2/296* (2013.01); *E04B 1/74* (2013.01); *E04C 2/42* (2013.01); *E04C 2/46* (2013.01); *E04B 2001/742* (2013.01)

(58) Field of Classification Search

CPC . E04C 2/288; E04C 2/296; E04C 2/42; E04C 2/46; E04B 1/74; E04B 2001/742

USPC ..... 52/576

See application file for complete search history.

(56) References Cited

U.S. PATENT DOCUMENTS

| | | | | | |
|---|---|---|---|---|---|
| 2,219,962 | A * | 10/1940 | Reynolds | F16J 15/123 | 49/479.1 |
| 2,235,001 | A * | 3/1941 | Allen | B28B 23/02 | 264/69 |
| 2,303,837 | A * | 12/1942 | Gurber | E04B 2/8635 | 52/426 |
| 2,373,409 | A * | 4/1945 | Myer | E04B 1/04 | 52/293.1 |
| 2,825,221 | A * | 3/1958 | Brouk | E04F 13/0862 | 52/293.1 |
| 3,077,149 | A * | 2/1963 | Eckel | E04B 5/43 | 267/89 |
| 3,500,595 | A * | 3/1970 | Bennett | E04B 1/3483 | 52/79.13 |
| 3,507,738 | A * | 4/1970 | Prusinski | B44C 5/04 | 428/71 |
| 3,693,308 | A * | 9/1972 | Trezzini | E04B 1/04 | 52/293.1 |

(Continued)

FOREIGN PATENT DOCUMENTS

| | | | | |
|---|---|---|---|---|
| CA | 2994868 | | 4/2018 | |
| EP | 1884352 | A2 * | 2/2008 | B28B 19/003 |

(Continued)

*Primary Examiner* — Brian D Mattei
*Assistant Examiner* — Joseph J. Sadlon
(74) *Attorney, Agent, or Firm* — Oyen Wiggs Green & Mutala LLP

(57) ABSTRACT

A structural insulation panel (SIP) is made of a central insulation material or block core covered with cementitious material. The layers of cementitious material are reinforced with fiber mesh sheets, rebar and corner blocks. The corner blocks are held in thickened cementitious material edges by reinforcement pins that are fixed to the corner blocks. The corner blocks are accessible for lifting the panel and for assembling multiple panels to build a wall.

14 Claims, 6 Drawing Sheets

(56) References Cited

U.S. PATENT DOCUMENTS 3,703,058 A * 11/1972 Klett ..... E04B 1/34823 52/79.13
3,965,635 A * 6/1976 Renkert ..... B28B 19/0053 52/434
4,031,682 A * 6/1977 Renkert ..... B28B 19/0053 52/434
4,181,286 A * 1/1980 Van Doren ..... B28B 7/06 249/111
4,226,071 A * 10/1980 Bennett ..... E04B 1/76 52/264
4,329,827 A * 5/1982 Thorn ..... E04B 7/22 52/790.1
4,350,483 A * 9/1982 Bonnet ..... B28B 23/0068 425/115
4,512,126 A * 4/1985 Walston ..... E04B 1/14 52/251
4,531,338 A * 7/1985 Donatt ..... E04F 13/0862 52/235
4,606,165 A * 8/1986 Allan ..... E04B 1/04 52/583.1
4,811,536 A * 3/1989 Hardt ..... E04B 1/0007 52/250
4,841,702 A * 6/1989 Huettemann ..... E04B 5/04 52/309.12
4,974,380 A * 12/1990 Bernander ..... E04B 2/562 52/235
5,095,674 A * 3/1992 Huettemann ..... E04B 5/04 264/34
5,104,715 A * 4/1992 Cruz ..... E04C 2/205 156/250
5,624,607 A * 4/1997 Kanai ..... C04B 22/0066 252/606
5,950,386 A * 9/1999 Shipman ..... E04F 11/00 52/481.2
6,205,729 B1 * 3/2001 Porter ..... B32B 29/00 52/309.7
6,224,706 B1 * 5/2001 Matich ..... B32B 7/08 156/212
6,526,714 B1 * 3/2003 Billings ..... B28B 1/16 52/268
6,658,799 B1 * 12/2003 Stoodley ..... E04B 1/34823 52/79.2
7,028,440 B2 * 4/2006 Brisson ..... E04B 1/12 52/309.16
7,168,216 B2 * 1/2007 Hagen, Jr. ..... B29C 44/186 52/480
7,627,997 B2 * 12/2009 Messenger ..... E02D 27/02 52/309.17
7,810,293 B2 * 10/2010 Gibbar ..... E04C 2/288 52/309.7
8,065,846 B2 * 11/2011 McDonald ..... E04B 5/10 52/281
8,256,173 B2 * 9/2012 Sarkisian ..... E04B 5/32 52/223.6
8,499,514 B2 * 8/2013 Farrell, Jr. ..... E04C 2/044 52/371
8,567,153 B1 * 10/2013 Francavilla ..... E04B 2/845 52/741.13
8,601,758 B2 * 12/2013 Biadora ..... E04B 2/12 52/223.7
8,844,227 B1 * 9/2014 Ciuperca ..... E04C 2/205 52/309.11
8,857,123 B2 * 10/2014 Culpepper ..... E04F 13/0869 52/533
8,904,737 B2 * 12/2014 Schiffmann ..... E04B 1/0007 52/793.1
9,084,489 B2 * 7/2015 Gosling ..... A47B 5/00
9,169,643 B2 * 10/2015 Dryburgh ..... E04C 2/06
9,376,815 B1 * 6/2016 Santini ..... E04C 2/06
9,399,867 B2 * 7/2016 Di Lorenzo ..... E04B 1/043
9,493,938 B2 * 11/2016 Schiffmann ..... E04C 2/246
9,631,359 B2 * 4/2017 Malakauskas ..... E04B 1/34861
9,649,662 B2 5/2017 Strachan
9,649,663 B2 5/2017 Strachan
9,890,531 B2 * 2/2018 Liberman ..... E04B 2/48
9,951,519 B2 * 4/2018 Neil ..... E04F 15/02038
10,066,393 B1 * 9/2018 Menendez ..... E04C 2/02
10,370,845 B2 * 8/2019 Francies, III ..... E04B 1/483
10,550,565 B2 * 2/2020 Heatly ..... E04C 2/044
10,865,562 B2 * 12/2020 Kreizinger ..... E04B 1/0007 52/250
10,900,222 B2 * 1/2021 Smith ..... E04B 1/86
2002/0043045 A1 * 4/2002 Marino Del Din ..... E04B 5/38 52/783.1
2004/0035071 A1 * 2/2004 Ho ..... E04F 19/10 52/390
2011/0023410 A1 * 2/2011 Hernandez Gallardo ..... E04C 2/044 52/794.1
2013/0192157 A1 * 8/2013 Coyle ..... E04B 1/14 52/586.1
2020/0208419 A1 * 7/2020 Watson ..... E04B 2/02
2020/0299960 A1 * 9/2020 Sharma ..... E04C 2/292

FOREIGN PATENT DOCUMENTS

WO WO-9423143 A1 * 10/1994 ..... E04B 5/00
WO WO-2016025987 A2 * 2/2016 ..... E04C 2/292

* cited by examiner

REINFORCED STRUCTURAL INSULATION PANEL WITH CORNER BLOCKS

TECHNICAL FIELD

The present invention is related to a reinforced structural insulation panel (SIP). More specifically, it relates to a SIP with corner blocks that are enclosed in the SIP in order to improve the reinforcement, maneuverability and the modularity of the panel.

BACKGROUND

The prefabrication of the structural insulation panel or SIP is a major improvement in the construction field. The SIP is usually prepared and assembled off-site. One type of SIP is usually made of several components, among them a central insulation core or block core made of expanded polystyrene foam (EPS), extruded polystyrene foam (XPS), polyisocyanurate foam, polyurethane foam or composite honeycomb (HSC) and two layers of structural skin or structural board that can be made of sheet metal, plywood, cement, magnesium oxide board or oriented strand board (OSB). The composition of a SIP is chosen in order to impart to the SIP a light weight, good fire resistance, water resistance and strength.

Preparing the SIP in a factory instead of on-site minimizes the cost of production of the SIP. In the meantime, the quality control of each produced SIP is improved because the influence of external parameters, such as the construction site, the weather and the construction workers, is minimized.

This background is not intended, nor should be construed, to constitute prior art against the present invention.

SUMMARY OF INVENTION

The present invention is related to a SIP that has features for improving the reinforcement, maneuverability and the modularity of a basic SIP. The SIP has a series of reinforcement components at each of its corners. In particular, the SIP is reinforced with corner blocks placed at each corner and integrated with the SIP. The corner blocks reinforce the corners while being embedded in the structure of the SIP.

The corners of SIPs, in general, are the parts of the SIP that are more susceptible to experience failure or weakening when the SIP is lifted or carried for transportation or around a construction site. The corner blocks also act as a point of fixation where a hook can be mounted in order to lift the SIP. In addition to their reinforcement role, the corner blocks enable the attachment of several reinforced SIPs to each other to form a modular wall. The corner blocks may also facilitate the alignment of the SIPs in the wall. Depending on the embodiment, the SIPs disclosed herein provide at least one of the advantages described in relation thereto.

Disclosed herein is a structural insulated panel (SIP) comprising: a core made with one or blocks of insulation material, the core defined by two opposing faces connected by stepped edges; a layer of cementitious material bonded to each face of the core; a peripheral wall of cementitious material extending from one of said layers into a step of the stepped edges; rebar embedded in the peripheral wall; a corner block in a corner of the SIP, the corner block defining a hole that is accessible by a tool that lifts the SIP; and two reinforcement pins connected to and projecting from different adjacent faces of the corner block into different straight sections of the peripheral wall, wherein each reinforcement pin has a head with a diameter that is larger than a diameter of a shank of the reinforcement pin, each head being distal from the corner block.

Also disclosed is a method of fabricating a structural insulated panel (SIP) comprising: forming a core with one or more blocks of insulation material, the core defined by two opposing faces connected by stepped edges; connecting two reinforcement pins to a corner block so that they project from different adjacent faces of the corner block, wherein each reinforcement pin has a head with a diameter that is larger than a diameter of a shank of the reinforcement pin, each head being distal from the corner block, wherein the corner block defines a hole that is accessible by a tool that lifts the SIP; pouring a first layer of cementitious material into a form; placing the core on the first layer of cementitious material; positioning rebar in a step of the stepped edges; positioning the corner block with the connected reinforcement pins at a corner of the SIP; pouring cementitious material around the stepped edges, to form a peripheral wall of cementitious material extending from the first layer into a step of the stepped edges and to embed the rebar in different straight sections of the peripheral wall; pouring a second layer of cementitious material over the core; and allowing the cementitious material to cure and bond to the faces of the core.

BRIEF DESCRIPTION OF THE DRAWINGS

The following drawings illustrate embodiments of the invention, which should not be construed as restricting the scope of the invention in any way.

DESCRIPTION

A. Glossary

EPS—Expanded polystyrene

SIP—Structural insulation panel

B. Exemplary Apparatus

Figure 1:
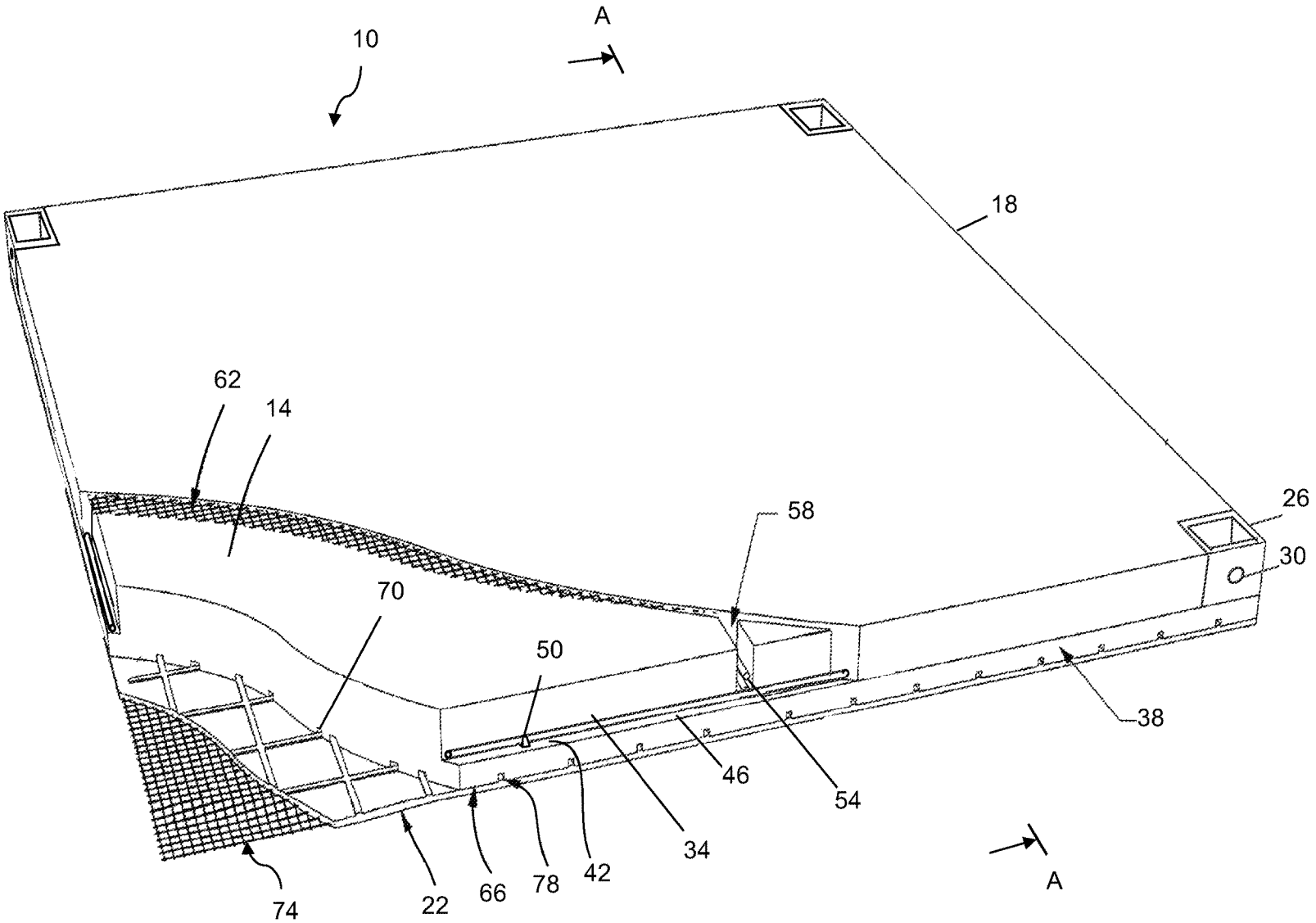
FIG. 1 is a drawing representing an arrangement of a reinforced SIP from a perspective view, where a portion of the SIP is cutaway so as to view various layers of the SIP, according to an embodiment of the present invention.

Referring to FIG. 1, there is shown an embodiment of a reinforced SIP 10. The SIP 10 is made of a central insulating block core 14. The insulating core 14 may be made of a thermally insulating material such as expanded polystyrene (EPS) or mineral fiber and covered on its upper surface by an upper cured cementitious layer 18 and underneath by a lower cured cementitious layer 22. The cured cementitious layers 18, 22 may be concrete, for example. The SIP 10 has a rectangular shape. In some embodiments, the SIP 10 has a different shape. The SIP 10 has a corner block located at each corner, such as the corner block 26 located at the corner between the bottom side and right side of the upper level of the SIP 10. The corner block 26 has a cube shape with 4 closed faces and 2 open faces or apertures. Each closed face has a circular opening or hole 30 at the center of the face. In other embodiments, the number of holes in the corner block varies, the sizes of the holes vary, the positions of the holes vary, and the shapes of the holes vary.

The reference to, for example, the sides as left and right and the surfaces as top, bottom, upper or lower, interior or exterior is non-limiting and simply for convenient reference, as the SIP 10 can be oriented in a variety of ways depending on how it is used in the construction of a building. It is worth noting that the actual rectangular shape, the proportions and the dimensions of the SIP are simply an embodiment of the present invention and can be subjected to modification depending on the specificity of the SIP 10.

The insulating core 14 has two levels: an upper level 34 and a lower level 38. The overall size of the upper level 34 is smaller than the overall size of the lower level 38. The two levels 34 and 38 are joined using glue, unless the levels are made from a single contiguous piece. The difference in overall sizes between the two levels 34 and 38 defines a ledge 42 around the central part of the insulating core 14. The presence of the ledge 42 results in the insulating core 14 having stepped edges around its perimeter. A rebar 46 is positioned over the ledge 42 on the bottom side of the SIP 10. In some embodiments, the rebar is made of a carbon steel, stainless steel, glass fiber or carbon fiber in order to reinforce the cured cementitious 18 enclosing the rebar. The position of the rebar 46 is maintained on the ledge 42 using a rebar holder 50 fixed onto the ledge.

Other rebar 54 is positioned in a channel 58 located in the middle, between the left and right ends of the insulating core 10. In some embodiments, one or more rebar lengths are positioned inside the channel 58. The channel 58 extends from the top side to the opposing bottom side of the SIP 10. The channel 58 is located in the upper level 34 of the insulating core 14. The concrete layer 18 covers and fills the channel 58, embedding the rebar 54. In some embodiments, the SIP 10 is not reinforced in its middle section.

A fiber mesh sheet 62 such as fiberglass scrim or carbon fiber mesh is used to reinforce the upper concrete layer 18.

Underneath, on the exterior surface 66 of the insulating core 14, a grid of grooves 70 is present. The exterior surface faces towards the outside of the building in which the SIP 10 is to be installed. The lower cured cementitious layer 22 on the underneath of the SIP 10 is also reinforced by a fiber mesh sheet 74. The lower cured cementitious layer 22 partially enters into each groove 70 in order to define empty channels 78 between the exterior surface 66 of the insulating core 14 and the lower cured cementitious layer 22. This type of empty channel 78 facilitates moisture release from the cured cementitious material when the SIP 10 is in a humid environment. In addition, the channels 78 act as a way of equalizing the pressure when the atmospheric pressure changes. As a result, the bonding between the cured cementitious layer 22 and the exterior surface 66 of the insulating core 14 is more resilient.

Figure 2:
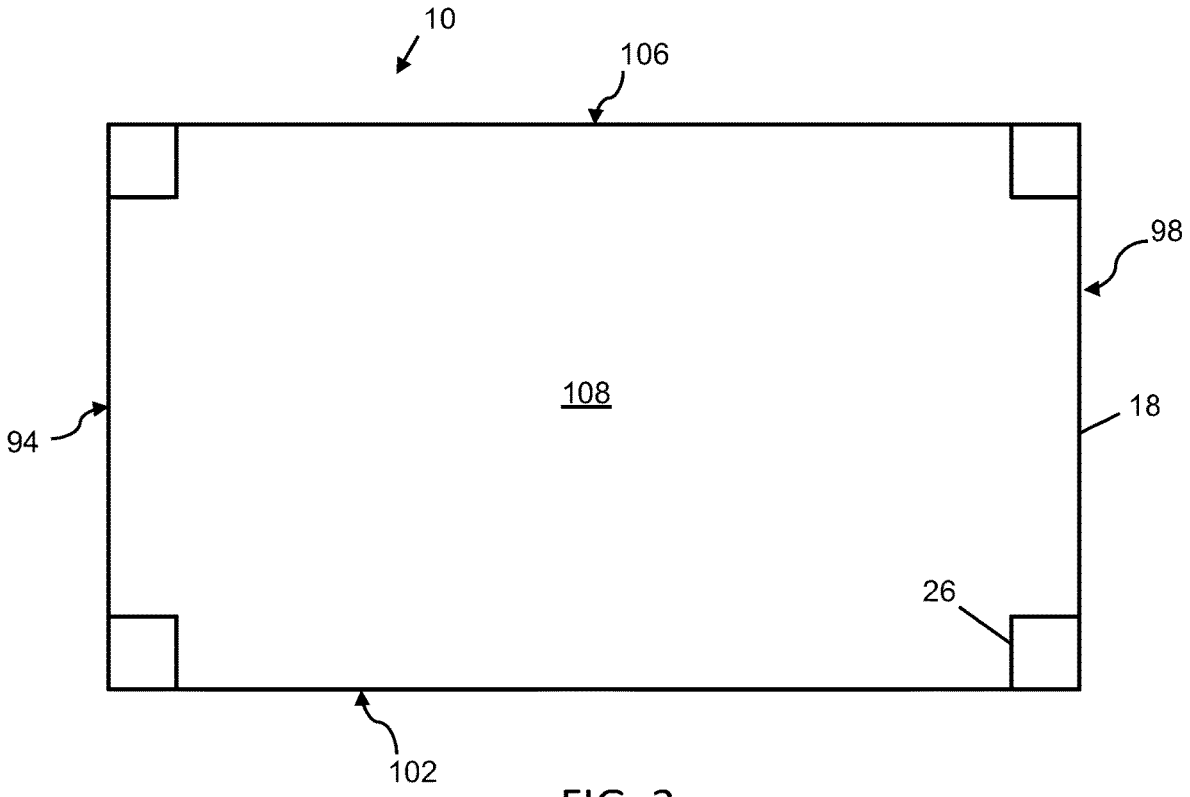
FIG. 2 is a schematic drawing representing a reinforced SIP as seen from above, according to an embodiment of the present invention.

Referring to FIG. 2, there is shown the SIP 10 as seen from above. The SIP 10 is rectangular with a left side 94, a right side 98, a bottom side 102 and a top side 106. The interior surface 108 of the SIP is that of the upper cured cementitious layer 18. The interior surface 108 faces towards the inside of the building in which the SIP 10 is to be installed. The SIP 10 has corner blocks positioned at each corner such as the corner block 26 located at the bottom right part of the SIP.

Figure 3:
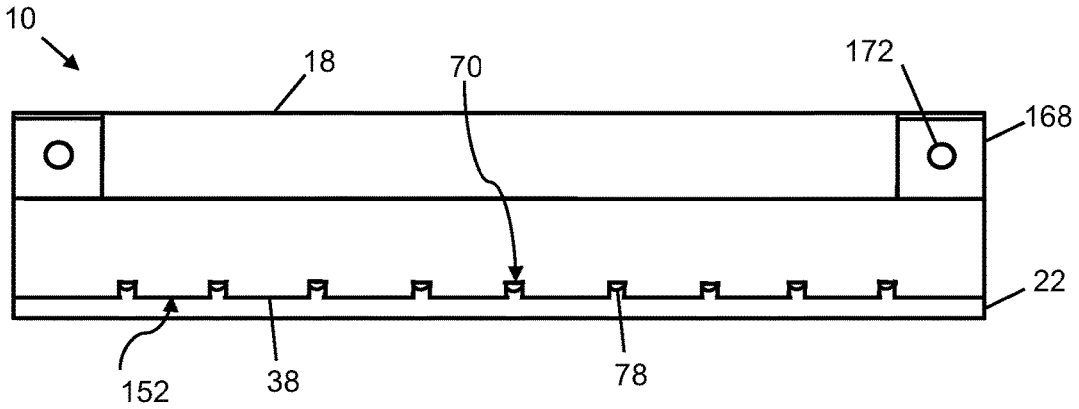
FIG. 3 is a schematic drawing representing a reinforced SIP as seen from the left side, according to an embodiment of the present invention.

Referring to FIG. 3, there is shown the left side 94 of the SIP 10. The upper cured cementitious layer 18 of the SIP is in contact with the lower level 38 of the insulating core 14. The exterior surface 152 of the lower level 38 of the insulating core has a series of grooves 70 that are partially filled with the lower cured cementitious layer 22 underneath. The lower cured cementitious layer 22 partially enters the grooves 70 to form empty channels 78. A corner block 168 with a circular hole 172 is disposed at each corner on the left side 94 of the SIP 10.

Figure 4:
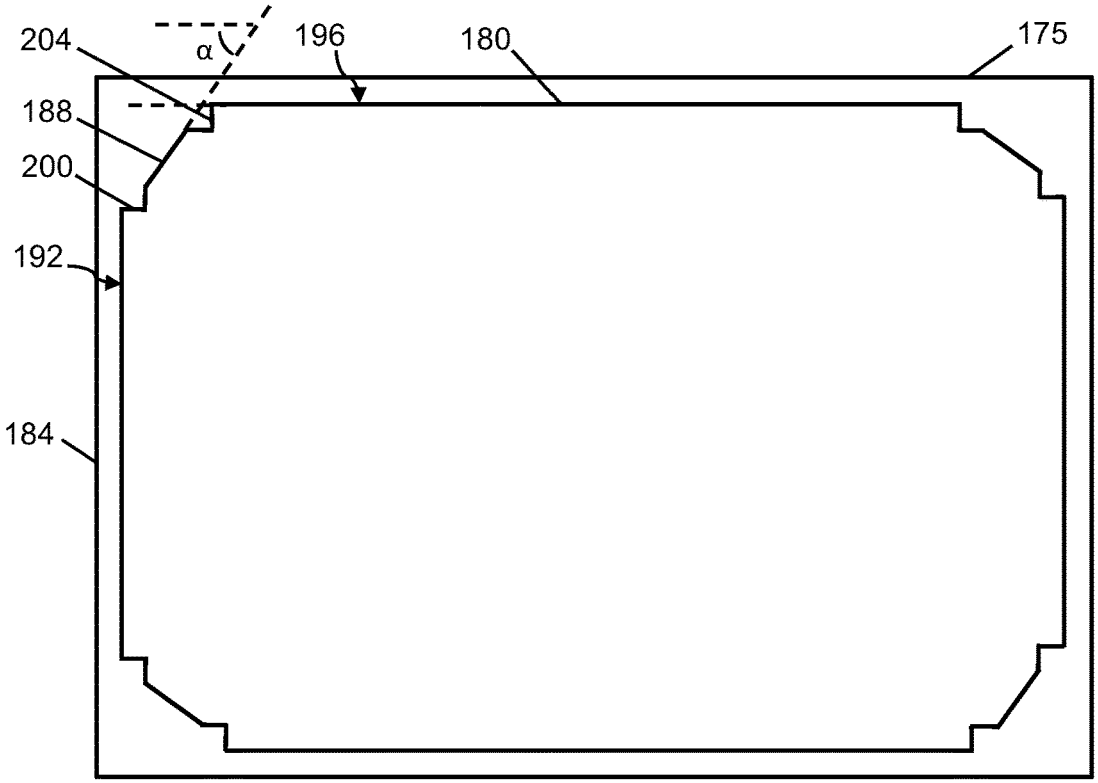
FIG. 4 is a schematic drawing representing an insulating core as seen from above, according to an embodiment of the present invention.

Referring to FIG. 4, there is shown an exemplary embodiment of the insulating core 175 as seen from above. The upper level 180 of the insulating core has a shape that has smaller dimensions than the lower level 184. The shape of the upper level 180 can be approximated to a truncated rectangle or an irregular octagon. The corner face 188 located at one of the corners of the upper level 180 forms an angle $\alpha$ of 45° to the faces 192, 196 adjacent to the top, right corner of the upper level. The same applies to the other corners. In addition, two notches are positioned at the extremities of each corner face, for example, two notches 200, 204 are present in the corner face 188. In some embodiments, the geometry of the corners of the upper level 180 is different.

Figure 5:
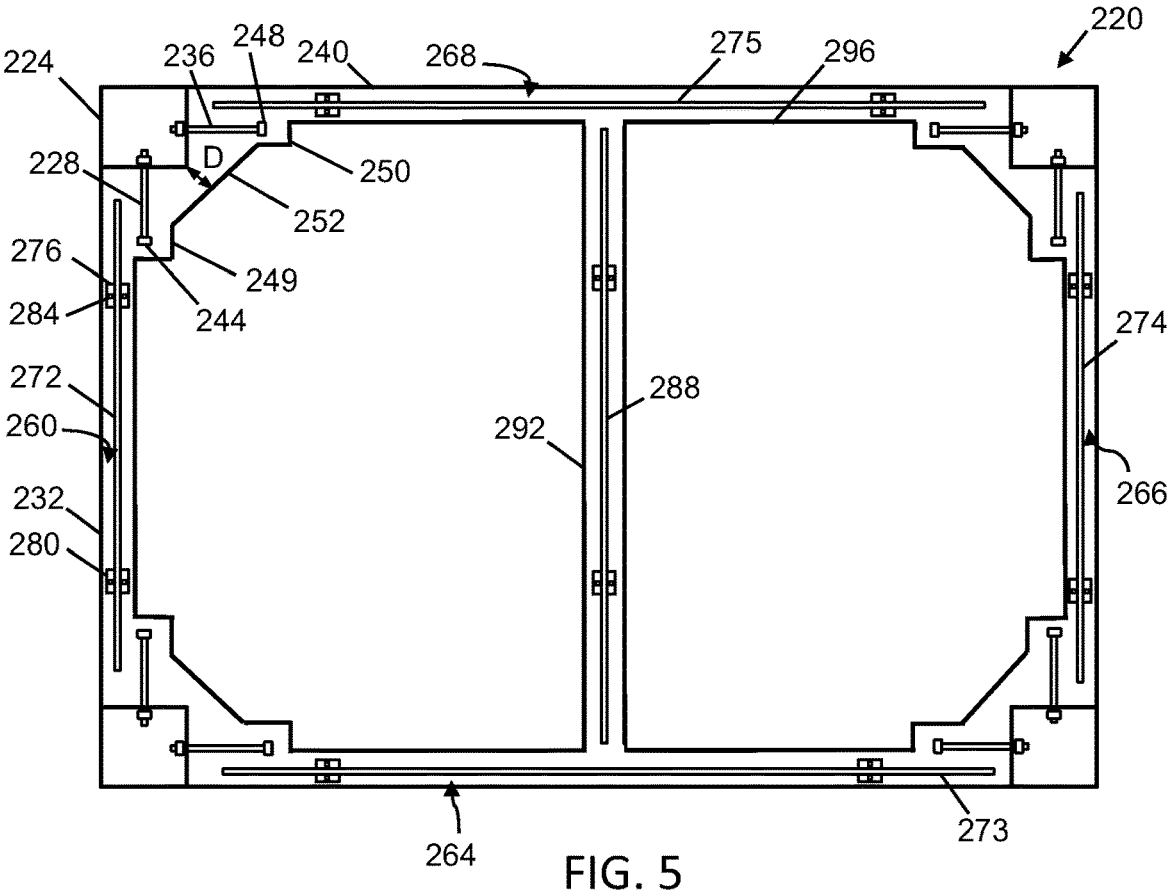
FIG. 5 is a schematic drawing representing a components of the SIP as seen from above, according to an embodiment of the present invention.

Referring to FIG. 5, there is shown another exemplary embodiment of the insulating core 220 with corner blocks 224 disposed at each corner of the insulating core and rebar (e.g. 272) disposed along the side ledges (e.g. 260) of the block core. The rebar 272 can be considered to be in the step of the stepped edges of the block core. Each corner block 224 has two reinforcement pins 228, 236 (e.g. bolts with a hexagonal head), each fixed at one end to an inner-facing side face of the corner block. As an example, the corner block 224 has a reinforcement pin 228 that is parallel to the edge of the right side 232 of the insulating core and oriented inward into the SIP away from the corner, and a second reinforcement pin 236 that is parallel to the top side 240 of the insulating core and oriented inward into the SIP away from the corner.

The role of the hexagonal heads 244, 248 mounted at the other end of the reinforcement pins 228, 236 is to maintain and reinforce the position of the corner block 224 when the cured cementitious layer covers the insulating core 220 and embeds the reinforcement pins. In some embodiments, the hexagonal heads 244, 248 are replaced by other, differently shaped components that are used to provide a tensile mechanical joint with the cured cementitious material at the inner extremity of the reinforcement pins 228, 236. Also, the shank of the reinforcement pins 228, 236 may be shaped to increase the surface area of the pins in contact with the cementitious material. The heads 244, 248 of the pins 228, 236 are positioned inside, or partially inside, the two notches 249, 250 of the corner face 252. The distance D between the corner block 224 and the corner face 252 of the upper level of the insulating core 220 should be sufficient to decrease the risk of cracking of the cured cementitious material when the corner block is subjected to normal loads or stress, subject to any required safety margins. For example the distance D is greater than the thickness of the cured cementitious layers on the faces of the insulating core 14.

In some embodiments, the method of fixing the reinforcement pins 228, 236 to the corner blocks 224 is different, for example, the reinforcement pins can be directly welded to the corner blocks. However, one advantage of providing the reinforcement pins and the corner blocks separately to the fabrication site is that they can be more closely packed for shipping. Furthermore, the management of sheer forces in a bolted ("lock and key") connection configuration rather than a welded configuration provides a greater allowance for seismic protection. The overall composite structure and configuration of the SIP also contributes to seismic protection.

The rebar 272, 273, 274, 275 located on the side ledges 260, 264, 266, 268 of the insulating core 220 is held in position using rebar holders. For example, rebar 272 is held in place by two rebar holders 276 and 280 fixed on the ledge 260 close to the left side 232 of the insulating core 220. Rebar 272 is locked by means of two arms 284 located, for example, on the rebar holder 276. These rebar holders 276, 280 raise the rebar 272 above the ledge 260 and thus eliminate the contact area between the rebar and the ledge 260. Therefore, when the cementitious mix is poured over the ledge 260 of the left side 232, the rebar 272 becomes fully enclosed or embedded in the cured cementitious material. This optimizes the action of the rebar 272 on the reinforcement of the cementitious material, specifically the reinforcement of the side edges of the SIP. In addition, the cementitious material that encloses the rebar is also reinforced with fibre mesh strips placed on the side ledges, either parallel to the upper surface of the ledges or parallel to the side face of the upper level 296 of the insulating core 220.

This SIP 220 is also reinforced in its middle section by rebar 288 placed in a channel 292. For this reason, a channel 292 is cut in the upper level 296 in order to host one or more lengths of rebar 288. The channel 292 connects the top-side ledge 268 to the bottom-side ledge 264. The depth of the channel 292 is chosen in such a way that the bottom surface of the channel is at the same level as the surface of the side ledges 264 and 268. The rebar 288 positioned in the central channel 292 is held in place using rebar holders in the same fashion as for the side rebar, 272, 273, 274, 275.

As an example only, the corner block is made from a 4 inch (10 cm) length of hollow structural steel with a 4 inch (10 cm) square cross-section and ⅜ inch (9 mm) wall thickness.

Figure 6:
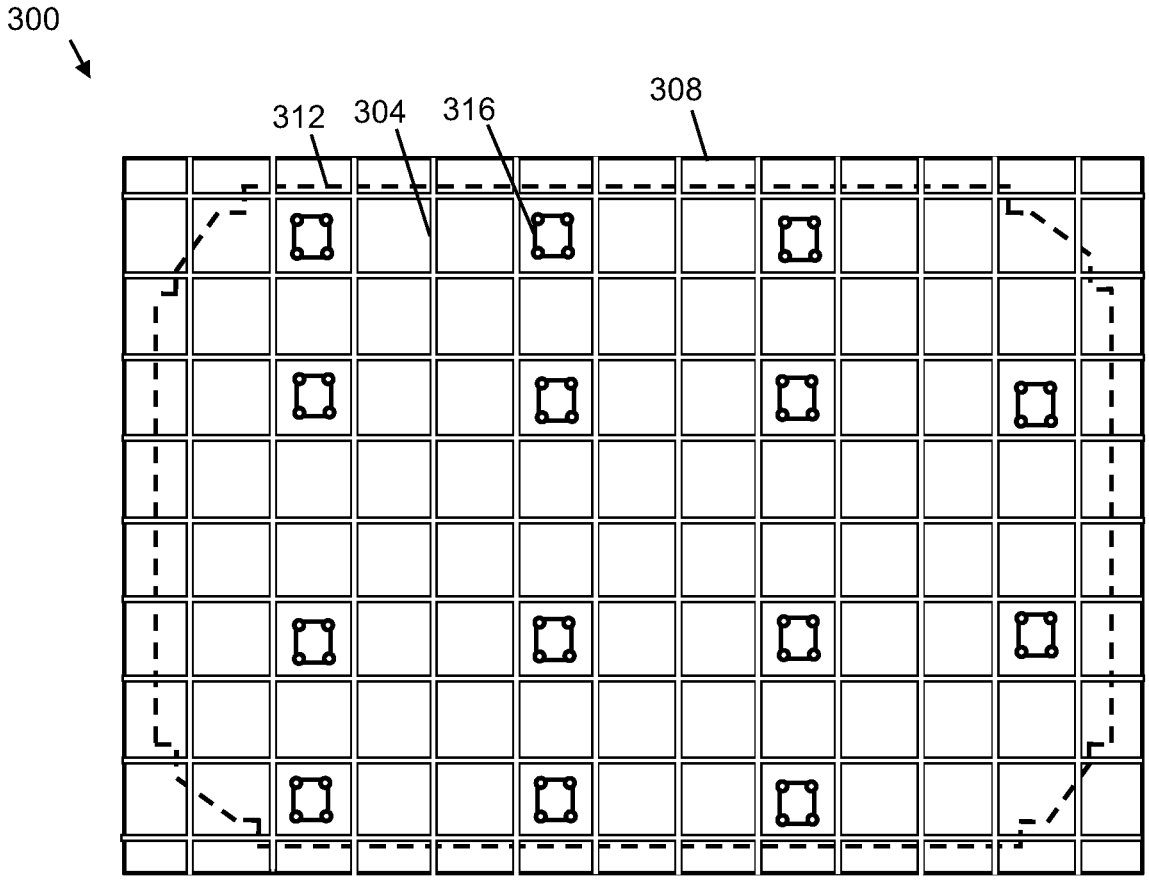
FIG. 6 is a schematic drawing representing an insulating core seen from underneath, according to an embodiment of the present invention.

Referring to FIG. 6, there is shown an insulating core 300 as seen from underneath, presenting the grid of grooves 304 present on the exterior surface of the lower level 308 of the insulating core. The upper level 312 of the insulating core does not have a grid of grooves 304. In some embodiments, the pattern for the grid of grooves 304 differs in regards to the application of the SIP. The depth of grooves 304 is less than about half of the thickness of the lower level 308 of the insulating core. For example, the grooves 304 are 0.75 inches (19 mm) deep and 0.5 inches (13 mm) wide, while the thickness of the lower level 308 is 1.5 inches (38 mm). The depth of the grooves 304 that are parallel to the right and left side edges of the SIP and the depth of the grooves perpendicular to the top and bottom side edges of the insulating core are the same. In some embodiments, the depth of the grooves is different in regards to the SIP's specific application. Standoff devices such as standoff 316 are placed on the surface of the lower level 308 of the insulating core.

Figure 7:
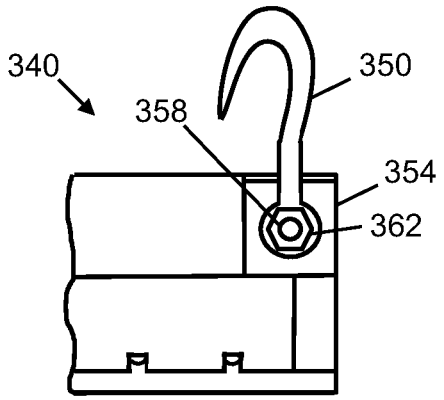
FIG. 7 is a schematic view of a corner of the SIP connected to a hook, according to an embodiment of the present invention.

Referring to FIG. 7, there is shown an embodiment of a corner of a SIP 340 as shown from the side. In this embodiment, a hook 350 is mounted on the corner block 354 using a set screw 358 and a hex nut 362. The hook 350 is used to lift and move the SIP 340. For example, the SIP 340 can be carried using a crane on a construction site.

Figure 8:
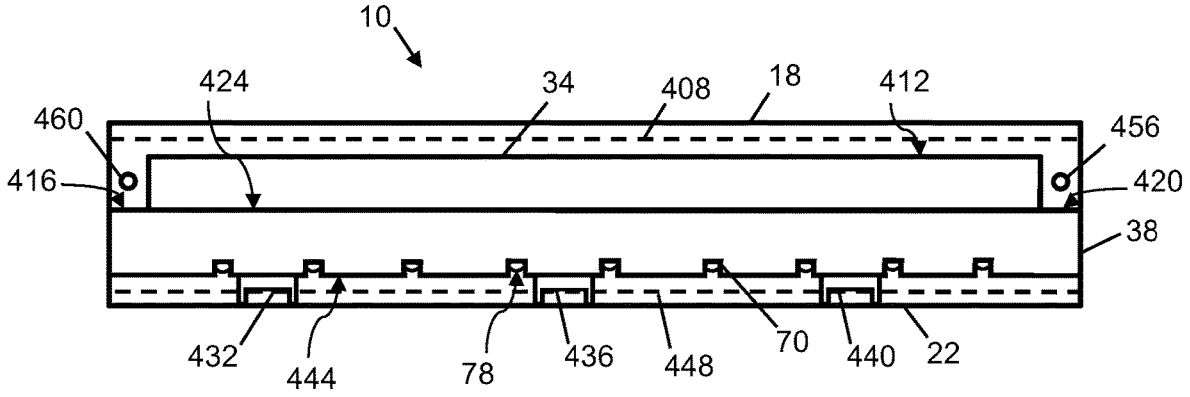
FIG. 8 is a schematic drawing representing a horizontal cross-section taken on line A-A of FIG. 1, according to an embodiment of the present invention.

Referring to FIG. 8, there is shown a cross section of an embodiment of the SIP 10. An upper cured cementitious layer 18 encloses a fiber mesh sheet 408 that covers and is spaced above the interior surface 412 of the upper level 34 of the insulating core and the ledges 416 and 420 formed by the interior surface 424 of the lower level 38 of insulating core. The fiber mesh sheet 408 reinforces the upper cured cementitious layer 18.

Standoffs 432, 436, 440 are positioned under the exterior surface 444 of the lower level 38 of the insulating core, and serve to maintain a uniform thickness of cementitious mix below the insulating core during its fabrication. The standoffs 432, 436, 440 positioned on the insulating core also maintain the position of the fiber mesh sheet 448 so that it becomes embedded in the lower cured cementitious layer 22 during fabrication. The fiber mesh sheet 448 reinforces the lower cured cementitious layer 22. The fiber mesh sheets 408 and 448 should not be in contact with the insulating core surface. If the fiber mesh sheets 408, 448 are in contact with the surface of the insulating core, the upper and lower cured cementitious layers 18 and 22 will not be reinforced optimally. Moreover, the fiber mesh sheets 408, 448 may hinder the adhesive bonds between the cured cementitious layers 18, 22 and the surfaces 412, 444 of the insulating core.

The rebar 456, 460 is embedded in the thickened edges of cured cementitious layer 18 to the sides of the upper level 34 of the insulating core and above the ledges 416, 420 formed by the side edges of the lower level 38 of the insulating core. The thickened edges of cured cementitious material form a peripheral wall that extends from the upper cured cementitious layer 18 into the step formed by the ledges 416, 420, i.e. part way down the stepped edges of the block core.

The exterior surface 444 of the lower level of the insulating core has grooves such as the groove 70. Standoffs 432, 436, 440 are positioned on the exterior surface 444 of the insulating core between the grooves 70. The standoffs 432, 436, 440 keep the fiber mesh sheet 448 enclosed by the lower cementitious layer 38 during pouring of the cementitious mix. When the insulating core is placed on the freshly poured lower cementitious layer 22, the cementitious material enters partway into the grooves 70 of the exterior surface of the insulating core in order to form empty channels 78.

C. Exemplary Method

Figure 9:
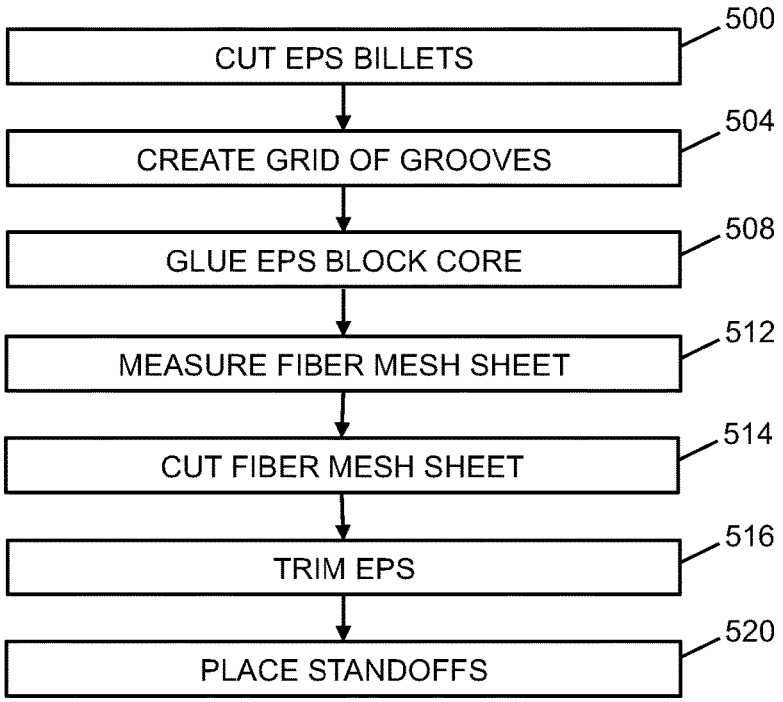
FIG. 9 is a flowchart describing the preparation of an insulating core and fiber mesh sheets, according to an embodiment of the present invention.

Referring to FIG. 9, there is shown an exemplary method for the preparation of an insulating core and fiber mesh sheets. In step 500, a first EPS billet of the prescribed length and width is placed onto a hotwire machine table or hot wire CNC foam cutter in order to be sliced to a prescribed thickness. A second EPS billet of the same length and width is then obtained and processed with a hot machine square to carve a grid of grooves on one of its surfaces in step 504.

After that, the two modified EPS billets are placed on an assembly table and glued together using a set of clamps in step 508. First, the glue is applied on each surface of the modified EPS billets to be joined. Then, the two modified EPS billets are allowed to sit with the glue for 2 minutes before being joined together to result in an EPS block core. A weighted bar is used on the top of the EPS block core to apply pressure to the joint area. In addition, a set of clamps is used to keep both EPS billets aligned with each other. The clamps are closed for a duration of 2 minutes.

Then in step 512, the measurement of the fiber mesh sheet is made by superimposing the fiber mesh sheets over each surface of the EPS block core (interior and exterior surfaces). The fiber mesh dimensions should correspond to the dimensions of the surface of the EPS block core.

The fiber mesh sheets are then cut to match the length and width of the EPS core in step 514.

The EPS block core is then positioned flat, with the grooves underneath. In step 516, the upper level of the EPS block core is trimmed using a hot-knife tool to create surfaces for laying the rebar and the corner blocks.

After that, the EPS block core is inverted so that the grooves are on top. The standoffs are placed onto the grooved surface of the EPS block core in step 520. The standoffs are more specifically placed at the center of squares defined by four interconnected grooves. Placement of the standoffs on the EPS block core is for positioning purposes. The outer fiber mesh is then aligned with the EPS block core while being placed onto the standoffs, at which point the mesh is then attached to the standoffs. The mesh, with attached standoffs is then removed.

Figure 10:
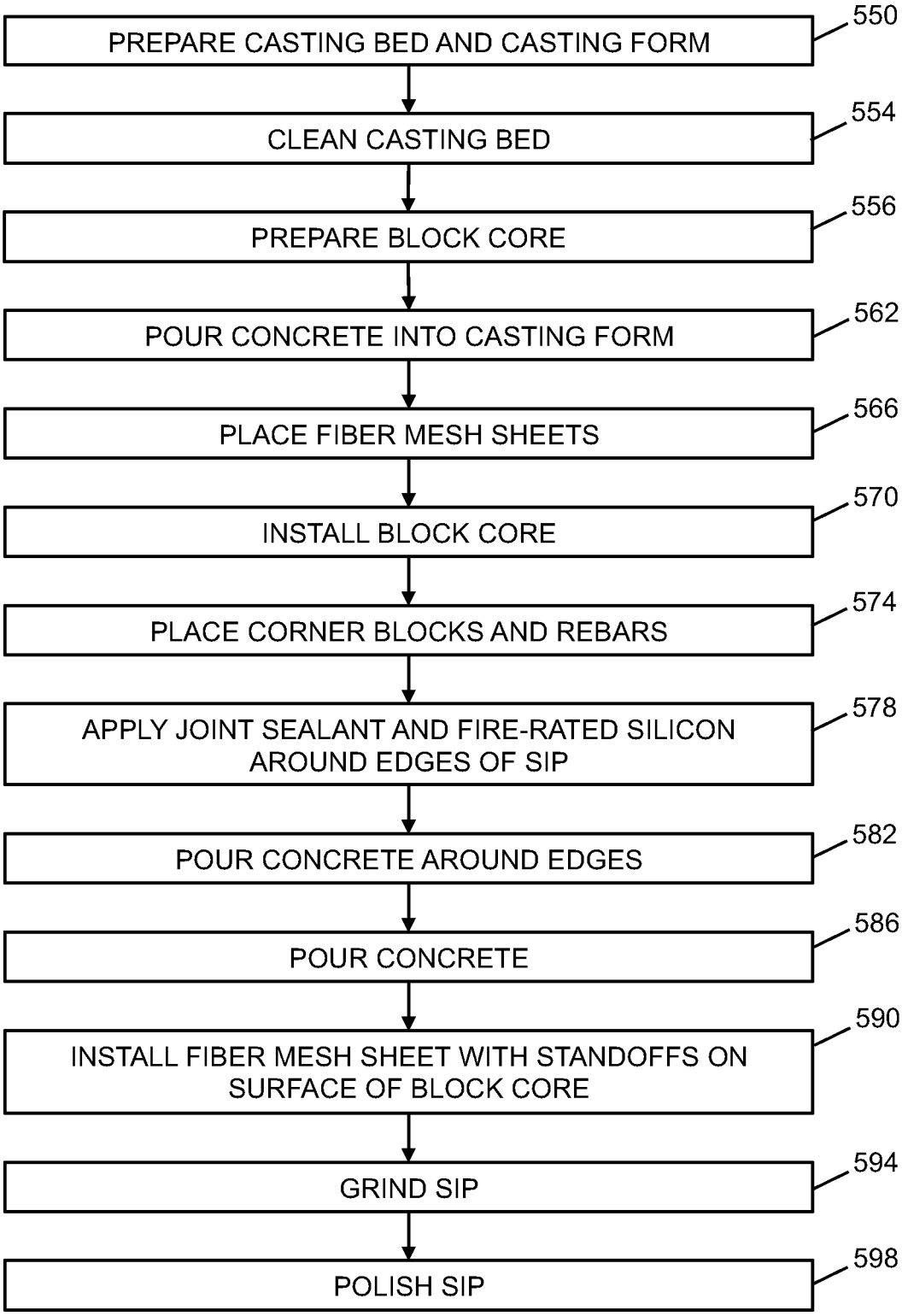
FIG. 10 is a flowchart describing the fabrication of a SIP, according to an embodiment of the present invention.

Referring to FIG. 10, there is shown an embodiment of the preparation of a SIP. In step 550, the casting bed and the casting form are prepared in regards to the desired SIP dimensions. The casting bed and the casting form are held in place using magnets. Optionally, supplementary frames for windows, doors or others elements that have to be incorporated in the SIP are placed inside the casting form. The positioning of the supplementary frame inside the casting form is set and secured using a set of right angled blocks.

After that, in step 554, the casting bed is cleaned using a cleanser, a release agent or a mold release spray and a microfiber pad. The release agent facilitates the detachment of the SIP from the casting form. The release agent is sprayed using a hand-held airless spray. The bottom surface of the casting bed is wiped down using a microfiber pad on an extension pole or manually for the more confined areas of the surface. The microfiber pad is used to provide a thorough cleaning process. In addition to the cleaning step, the internal edges of the casting form are sealed to each other and to the floor with caulking and left to cure for 20 minutes.

During the cleaning step, the first mix of cementitious slurry is prepared in a continuous mixer. The cementitious slurry is mixed and poured into a rolling cart. The cementitious slurry is left for 13 seconds in the rolling cart to achieve the desired consistency. A compression test is made for testing the consistency of the cured cementitious material using three samples of cementitious material in a mold containing three cavities. The slurry of cementitious material is then poured into a slurry pump in order to be poured later into the casting bed.

In the meantime, in step 556, an EPS block core is prepared as explained in relation to FIG. 9.

After that, a slurry of cementitious material is poured via the slurry pump into the casting bed to create the exterior surface of the SIP in step 562. A gauge rake is used to spread the slurry of cementitious material on the bottom face of the casting bed to obtain an even distribution. A leveling screed is passed over the casting form from end to end using the top of the form as a guide to confirm the correct thickness of the slurry of concrete.

The first fiber mesh sheet, with standoffs fixed on the fiber mesh sheet, is placed over the cementitious slurry in the casting bed in step 566. The bases of the standoffs are oriented upwards to support the EPS block core. The fiber mesh sheet is gently raked in using a porcupine rake.

Then the EPS block core is placed into the casting bed over the slurry of cementitious material in step 570. The EPS block core is gently pressed into the cementitious slurry with evenly applied pressure on each area of the EPS block core. When the EPS block core is in position, rebar is fixed on the side ledges of the EPS block core using rebar holders, and corner blocks are placed at each corner of the EPS block core in step 574. A dam is taped over each corner block in order to prevent any slurry from filling the interior of the corner blocks during the subsequent concrete pours. If necessary, a joint sealant and fire rated silicone is applied to the upper side edges of the EPS block core adjacent to the walls of the casting bed in step 578.

A second slurry of cementitious material is then poured around the edges of the EPS block core in order to cover the rebar placed on the side ledges of the EPS block core in step 582. The second slurry is prepared specifically for thickening the edge of the SIP. The slurry is then left to cure until it reaches the temperature of 24° C. or less.

Then in step 586, a third slurry of cementitious material is poured over the EPS block core in order to create the interior surface of the SIP. The slurry is spread evenly across the EPS block core and the thickened edges using a gauge rake. The level of the third slurry comes up to a level a little above (e.g. 0.5 inches or 13 mm) the tops of the corner blocks. After that, the second fiber mesh sheet, with corners cut out to match the corner blocks, is placed onto the slurry in step 590. The fiber mesh sheet is rolled into the slurry until the fiber mesh sheet is no longer visible and fully immersed in the slurry. A leveling screed is used to ensure an even and smooth surface. Then the SIP is then left to cure. Once a thin film has developed on the surface of the SIP, a mist of water is sprayed on the surface of the cementitious material. The surface is kept wet for at least 3 hours after the final pouring step.

The SIP is then lifted from the casting bed using lifting brackets fixed to the corner blocks and a crane. The SIP is placed on a rolling cart in order to be moved to a finishing area where the SIP is ground and polished.

The SIP is ground in step 594. The SIP edges are first ground using a low speed grinder to remove the curled-up edge created during the casting process. The edges have to be flat and as even as the rest of the SIP. Any sharp corners are rounded off until they are smooth using a hand pad. Then, the entire surface of the SIP is spread with water to dampen it but not to soak it. Immediately after, GM3000™ solution is applied and spread with a fine bristle broom. The surface of the SIP with GM3000™ solution is then ground using an 18" grinding machine with 7" metal/diamond segments to create a slurry that fills any surface pinholes. Once the entire surface has been ground with the slurry, it is left to cure for a minimum of 1 hour.

Then the SIP is polished in step 598. A HEPA (high-efficiency particle air) vacuum is used to polish the entire surface of the SIP using a grinder with an intermediate 100-grit pad T63 until the surface has a smooth polished finish. After that, a 200-grit resin FP44™ diamond pad mounted on the grinder is used to remove any swirl marks created by the previous treatment, to reveal a lightly matte finish that is ready for paint or any other preferred coating.

D. Variations

In some embodiments, the insulating core or EPS block core is replaced by a mineral fiber block core. The mineral fiber block core is cut to size a similar way to the EPS block core. However, in this example, the inner layer of the mineral fiber block core is in two pieces so that rebar can be included between the two pieces. The fiber mesh sheet is pre-cut to cover the mineral fiber block core when placed inside the casting form.

After the preparation of the casting form, the first slurry of cementitious material is poured and the fiber mesh sheet is placed in the slurry. The lower mineral fiber block core is then placed over the first slurry in the casting form. The two pieces of upper mineral fiber block are then placed on the lower block forming a central channel to receive rebar and rebar holders. When the upper mineral fiber block cores are placed inside the casting form, pre-cut wooden blocks are placed alongside the block core to maintain the space between the walls of the casting form and the block core. This space is further used to reinforce the edges of the SIP by means of rebar embedded in the cementitious material, held in position with rebar holders.

Strips of fiber mesh sheet are placed around the edges of the block core to be embedded by the thickened peripheral wall formed by the second slurry of cementitious material.

In some embodiments, a grid of grooves may be cut in the mineral fiber block.

The hook on the corner block can be replaced by a device that facilitates the attachment of adjacent SIPs to form the wall of a building.

In general, unless otherwise indicated, singular elements may be in the plural and vice versa with no loss of generality.

Throughout the description, specific details have been set forth in order to provide a more thorough understanding of the invention. However, the invention may be practiced without these particulars. In other instances, well known elements have not been shown or described in detail and repetitions of steps and features have been omitted to avoid unnecessarily obscuring the invention. Accordingly, the specification is to be regarded in an illustrative, rather than a restrictive, sense.

It will be clear to one having skill in the art that further variations to the specific details disclosed herein can be made, resulting in other embodiments that are within the scope of the invention disclosed. Two or more steps in the flowcharts may be performed in a different order, other steps may be added, or one or more may be removed without altering the main function of the invention. Flowcharts from different figures may be combined in different ways. All parameters, dimensions, materials, and configurations described herein are examples only and actual ones of such depend on the specific embodiment. Accordingly, the scope of the invention is to be construed in accordance with the substance defined by the following claims.

The invention claimed is:

1. A structural insulated panel (SIP) comprising:

a core made with one or blocks of insulation material, the core defined by two opposing faces connected by stepped edges;

a layer of cementitious material bonded to each face of the core;

a peripheral wall of cementitious material extending from one of said layers into a step of the stepped edges;

rebar embedded in the peripheral wall;

a corner block in a corner of the SIP, the corner block defining a hole that is accessible by a tool that is capable of lifting the SIP; and two reinforcement pins connected to and projecting from different adjacent faces of the corner block into different straight sections of the peripheral wall, wherein each reinforcement pin has a head with a diameter that is larger than a diameter of a shank of the reinforcement pin, each head being distal from the corner block wherein the core has an upper level and a lower level wherein the upper level has a smaller surface area than a surface area of the lower level, wherein the upper level of the core is a truncated rectangular prism, the truncated rectangular cross-section thereof having had its rectangular corners each truncated to form a corner face with two notches, and wherein a thickness of the cementitious material between the corner block and the nearest corner face of the upper level of the core is greater than a thickness of each layer of cementitious material bonded to the faces of the core.

2. The SIP of claim 1, wherein the reinforcement pins are hex bolts that are screwed into further, threaded holes in the corner block.

3. The SIP of claim 1, wherein the core is made of expanded polystyrene.

4. The SIP of claim 1, wherein the core is made of mineral fiber block.

5. The SIP of claim 1, wherein the layers of cementitious material are reinforced with fiber mesh sheets.

6. The SIP of claim 1, wherein the rebar is positioned in the step via rebar holders.

7. The SIP of claim 1, wherein the corner faces form a 45° angle with adjoining sides of the upper level of the core.

8. The SIP of claim 1, wherein the heads extend at least part way into the notches.

9. The SIP of claim 1, wherein:

the upper level of the core has a channel extending from one of the stepped edges to an opposing stepped edge;

the layer of cementitious material bonded to the upper level of the core extends into the channel; and rebar is embedded in the cementitious material that extends into the channel.

10. The SIP of claim 1, wherein:

each corner block has a hollow, cube shape open at opposing ends;

the hole is defined by a closed face of the corner block;

a further hole is defined by another closed face of the corner block adjacent to the closed face; and one of the open ends of the corner block is accessible from outside the SIP.

11. The SIP of claim 1, wherein a hook is bolted to the corner block via the hole.

12. The SIP of claim 1, wherein the reinforcement pins are welded to the corner block.

13. A structural insulated panel (SIP) comprising:

a core made with one or blocks of insulation material, the core defined by two opposing faces connected by stepped edges;

a layer of cementitious material bonded to each face of the core;

a peripheral wall of cementitious material extending from one of said layers into a step of the stepped edges;

rebar embedded in the peripheral wall;

a corner block in a corner of the SIP, the corner block defining a hole that is accessible by a tool that is capable of lifting the SIP; and two reinforcement pins connected to and projecting from different adjacent faces of the corner block into different straight sections of the peripheral wall, wherein each reinforcement pin has a head with a diameter that is larger than a diameter of a shank of the reinforcement pin, each head being distal from the corner block wherein the core has an upper level and a lower level wherein the upper level has a smaller surface area than a surface area of the lower level, wherein the upper level of the core is a truncated rectangular prism, the truncated rectangular cross-section thereof having had its rectangular corners each truncated to form a corner face with two notches, and wherein the heads extend at least part way into the notches.

14. A structural insulated panel (SIP) comprising:

a core made with one or blocks of insulation material, the core defined by two opposing faces connected by stepped edges;

a layer of cementitious material bonded to each face of the core;

a peripheral wall of cementitious material extending from one of said layers into a step of the stepped edges;

rebar embedded in the peripheral wall;

a corner block in a corner of the SIP, the corner block defining a hole that is accessible by a tool that is capable of lifting the SIP; and two reinforcement pins connected to and projecting from different adjacent faces of the corner block into different straight sections of the peripheral wall, wherein each reinforcement pin has a head with a diameter that is larger than a diameter of a shank of the reinforcement pin, each head being distal from the corner block, wherein:

each corner block has a hollow, cube shape open at opposing ends;

the hole is defined by a closed face of the corner block;

a further hole is defined by another closed face of the corner block adjacent to the closed face; and one of the open ends of the corner block is accessible from outside the SIP.

* * * * *